United States Patent [19]

Mathieson

[11] 4,027,828

[45] June 7, 1977

[54] PERFORATING MACHINE

[75] Inventor: Niall Mathieson, Montreal, Canada

[73] Assignee: Mackay Center Specialties, Inc., Montreal, Canada

[22] Filed: June 14, 1976

[21] Appl. No.: 696,036

[52] U.S. Cl. ..... 242/56.6

[51] Int. Cl.[2] ..... B65H 35/04

[58] Field of Search ..... 242/56.2, 56.6, 56.7, 242/66, 75, ; 83/346, 674, 302,

[56] References Cited

UNITED STATES PATENTS

| | | | |
|---|---|---|---|
| 868,361 | 10/1907 | Pope | 83/346 |
| 1,402,848 | 1/1922 | Dutro | 242/56.6 |
| 2,447,604 | 8/1948 | Taggart | 242/66 X |
| 3,232,549 | 2/1966 | Stambaugh | 242/66 |
| 3,471,098 | 10/1969 | Jannett | 242/75 |
| 3,792,637 | 2/1974 | Saunders | 83/302 |
| 3,853,279 | 12/1974 | Gerstein | 242/56.2 |

*Primary Examiner*—Edward J. McCarthy
*Attorney, Agent, or Firm*—Diller, Brown, Ramik & Wight

[57] ABSTRACT

A perforating machine for making tear lines in a woven or non-woven fiber sheet material. The machine comprises a feeder mechanism for feeding a web of sheet material. A roller assembly maintains the web stretched while a further roller imposes tension to the web along the longitudinal axis thereof. A perforating roll assembly is provided to cut fibers in the web along a line whereby to form a tear line substantially transverse to the direction of tension while maintaining the tension in the web. Traction rolls positively engage the web through the perforating roll assembly. An accumulator roll assembly receives the web after the tear lines have been made therein.

14 Claims, 2 Drawing Figures

PERFORATING MACHINE

BACKGROUND OF THE INVENTION a. Field of the Invention

The present invention relates to a perforating machine for making tear lines in a woven or non-woven fiber sheet material.

b. Description of Prior Art

In perforating paper, perforation is used primarily to direct a tear in the required location in the paper, a material that would otherwise tear easily without perforation. However, in the case of non-woven sheet material, particularly tough fiber, spun-bonded material, where the raw material is particularly resilient, it has proven difficult to provide effective perforated tear lines or wide webs of over 30". Perforations in this type material heretofore known, all but cut the web because the fibers are remarkably strong and only a few of these fibers are required to span the tear line in order to hold the sheet sections together along the tear line. Further, the differential between a web that will tear very easily and one that breaks in the process of re-rolling the perforated material is so small that any variation in tension, speed, etc., makes rewinding of a good perforated roll of such material exceedingly difficult. Also, materials which are impregnated with chemicals tend to cause a build-up of chemical on the rolls in a roll-type perforating machine, particularly whenever two rolls nip the fabric. It is, therefore, not possible to obtain traction by this type of an arrangement.

In order to perforate a web using the classical paper perforator, i.e., hardened steel rule dye revolving against a hardened steel roller, the male and female rollers must be large enough and strong enough not to deflect in the middle. If any deflection takes place when one is, for instance, cutting 0.003"–0.005" thick material, a 0.002" deflection will either not cut the web or burr the blade. It will also set up impossible vibration and wear. The only method for overcoming this is either to put in supports for the rolls, or use a larger and larger diameter roll, as the web width increases. In the case of an 80" web, it is estimated that the male and female roll diameters would have to be between 15" and 25" diameter in solid steel in order not to deflect 0.001". Since these type machines often require stopping and starting every 10 to 50 revolutions, the momentum inherent in such steel rollers makes such a design impractical.

In a known perforator for making tear lines in toilet tissue, a hacksaw blade rotates against a hardened neoprene or urethane insert on a female roll. The main problem in trying to adapt this type of machine to perforate nonwoven fiber material having rough fibers is that since there is no traction of friction between the female roll and the web, the male blade will merely depress the web into the neoprene pad without weakening the web. Accordingly, this type of perforator cannot perforate such material.

SUMMARY OF THE INVENTION

It is a feature of the present invention to provide a perforating machine for making tear lines in woven or nonwoven fiber sheet material of widths in excess of 30" and which substantially overcomes all of the above-mentioned disadvantages.

It is a further feature of the present invention to provide a perforating machine which is substantially economical, easy to construct and maintain, and relatively compact.

It is a still further feature of the present invention to provide a perforating machine which stretches the web material and forms a perforated tear line whilst the material is in a stretch condition, the tear line having 75 to 95% of the fibers therealong being severed.

A still further feature of the present invention is to provide a novel method of making perforated tear lines in a non-woven tough fiber sheet material.

According to the above features, from a broad aspect, the present invention provides a perforating machine for making tear lines in a woven or non-woven fiber sheet material, said machine comprising feeder means for feeding a web of said sheet material, means to maintain said web stretched, means to impose tension to said web, perforating means to cut fibers in said web along a lone extending substantially transverse to the direction of said tension to form a tear line while said tension is maintained in said web, traction means for positively engaging said web through said perforating means, and accumulator means to receive said web after tear lines have been made therein.

According to a further broad aspect, the present invention provides a method of making perforated tear lines in a non-woven tough fiber sheet material. The method comprises the steps of applying tension to a web of this type material and supporting the web on a roll while maintaining the web in a stretched condition. A cutting element, having a serrated cutting edge, is moved against the stretched web to sever 50 to 98% of the fibers along a line in the material to form a tear line.

BRIEF DESCRIPTION OF DRAWINGS

A preferred embodiment of the present invention will now be described with reference to the accompanying drawings in which.

DESCRIPTION OF PREFERRED EMBODIMENTS

Figures 1, 2:
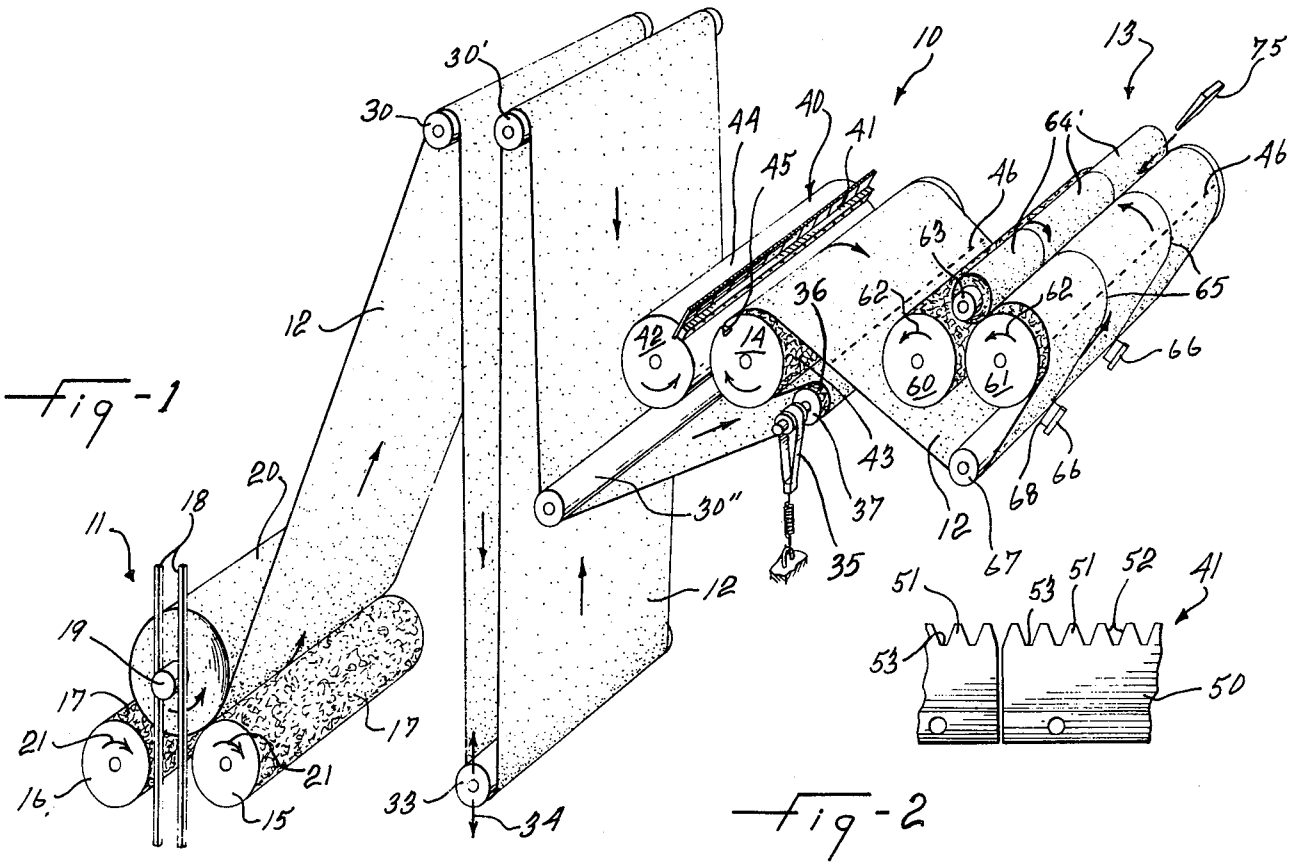
FIG. 1 is a perspective view showing a schematic version of the perforating machine of the present invention.
FIG. 2 is a fragmented side view illustrating a portion of the cutting element as utilized in the machine shown in FIG. 1.

Referring now to the drawings, there is shown in FIG. 1 a schematic representation of the main component parts of the perforating machine of the present invention. Of course, it is understood, that these elements are mounted and secured within a machine frame (not shown) and supplied with the necessary gearing and drive arrangements where necessary. This schematic representation better illustrates the invention to facilitate the description of same.

The perforating machine is generally shown at 10 and comprises basically a feeding means arrangement 11 at the input end of the machine for feeding a web 12 of sheet material required to be perforated. The web 12 may be a material formed of long spun-bonded fibers. The web is then trained through rolls which maintains the web stretch and imposes tension to the web. Whilst tension is imposed to the web, it is perforated along an axis substantially transverse to the direction of stretch and then fed to accumulating means 13 at the outlet end of the machine. The web is entrained through the machine by a traction means provided by a driven support roll 14 and other rolls in the machine.

The feeder means 11 comprises two spaced-apart substantially parallel drivable support rolls 15 and 16, respectively, each having a web engaging outer surface 17. This outer surface is constituted by either providing a knurled roll outer surface or attaching an abrasive paper product on the outer surface of the rolls. A vertical guide member herein constituted by two spaced-apart vertical rods 18, is secured adjacent each end of the support rolls 15 and 16 to receive and guide a support shaft 19 which extends through the core of a large roll 20 of the non-woven fiber sheet material 12. Means (not shown) is provided to maintain a downward pressure against the support shaft 19 whereby sufficient pressure is maintained between the outer periphery of roll 20 and support rolls 15 and 16 to cause unwinding of the web 12 when the rolls 15 and 16 are driven in the direction of arrows 21.

The unwound web 12 is then trained about a plurality of stationary idler rolls 30, 30′ and 30″. These idler rolls are held in spaced parallel relationship in the machine frame. The rolls 30 and 30′ are spaced apart a short distance whereby to cause the web 12 to form a downward loop 32 between the rolls. A dancer roll 33 is positioned within the loop to maintain the web in the loop stretched as it is freely displaceable in a vertical plane as indicated by arrow 34. Although not shown, the dancer roll 33 is captive at opposed ends thereof in a channel or guide member secured to the machine frame. The stationary roll 30″ constitutes a guidance idler roll. Rolls 30 and 30′ are also idler rolls.

From the guide idler roll 30″ the web is then entrained about an idler tension roll 37 provided with a webengaging outer surface 36 to provide positive engagement with the web 12. A braking means constituted by a spring loaded tension belt 35 retards the rotation of the roll 37 thus resisting rotation of the roll by the web and thus stretching the web. This will apply longitudinal stretch to the web between the roll 37 and the support roll 14. The belt 35 is adjustable to vary the tension in the web. The adjustable mechanism is not shown herein, but consists essentially of an adjustment of spring tension on the belt. The braking means could also be provided by any other suitable type of braking arrangement secured to the roll 37.

The perforating means is generally shown at 40 and comprises a cutting blade element 41 secured to a driven perforator roll 42 whereby the cutting blade 41 is in periodic contact with the web 12 trained about the web engaging outer surface 43 of the support roll 14. The surface 43 is also formed of abrasive material as are the rollers 15, 16 and the idler tension roll 35. As shown, the position of the roll 37 and roll 14 is such as to have maximum longitudinal engagement of the web about the surface 43 of roll 14. The cutting element 41 will sever the web at a distance approximately midway of its engagement with the roll 14.

The cutting element 41 extends longitudinally of the roll 42 and protrudes above the outer surface 44 thereof. The support roll 14 is provided with means in the outer surface thereof to permit the cutting blade 41 to form a tear line when in contact with the web. This means is a longitudinal slot 45 extending the length of the roll 14. The roll 42 is positioned close to the support roll 14 whereby the cutting element will contact a web adjacent the slot 45 to cut some of the fibers along a line to make a tear line 46 thereacross. As can be seen, tension is applied to the web between the tension roll 35 and the support roll 14 and this tension in the web is maintained about the portion of the periphery of the roll 14 by the abrasive surface 43. Thus, when the cut for the tear line 46 is made in the web, the material is in longitudinal tension.

Referring to FIG. 2, there is shown a manner of making the cutting element 41. As hereinshown, the element 41 is constituted by a plurality of conventionally known razor blades 50 but having the cutting edge made as a serrated cutting edge comprising a plurality of spaced-apart, substantially triangular, teeth 51 having opposed cutting edges 52 and a blunt area 53 is made in the troughs between each tooth 51. The blades 50 are secured in an elongated frame which is easily attached to the roll 42. Each individual blade is also detachable from the frame to permit replacement thereof when necessary.

After the tear lines 46 are formed in the web 12, the web is fed to the accumulator 13 which is constituted by a pair of closely spaced parallel support or reroll rolls 60 and 61 which are driven, by suitable drive means (not shown), in the same direction as illustrated by arrows 62. The rolls 60 and 61 also constitute traction rolls for the web. A mandrel cylinder 63 is supported on and rotatable between the support rolls 60 and 61. The web 12 is wound about the mandrel 63 by the rotation of the rolls 60 and 61. After a sufficient amount of perforated web is wound about the mandrel 63, the machine is stopped and the web is detached from the mandrel along a tear line 46 and the mandrel is then slipped out of the perforated roll 64 and the web 12 is advanced a sufficient distance to wind the free end thereof about the mandrel 63 and the machine operation is resumed. To assure that the web is fully extended transversely and tucked under the mandrel 63, air jets (not shown) may be provided as at 75. This causes the web to be tucked under the mandrel to start the winding about the mandrel.

The perforating machine 10 of the present invention is also adapted to slit the web 12 longitudinally whereby the roll 64 formed about the mandrel will contain three or more roll sections as shown at 64′. Thus, the machine can handle rolls 20 of large width and have an output of a plurality of smaller rolls wound on the mandrel.

To form the longitudinal slits 65, there is provided one or more slitting elements 66, hereinshown as razor blades, and positioned under the rolls 60, 61. A slitter roll 67 guides the web 12 against the cutting edge 68 of the blade 66 whereby the blades extend through the web to slit it longitudinally.

It has been found that the perforator 40 abovedescribed will make a perforation cut severing approximately from between 50 to 98% of the fibers in the web along a line to form the tear line 46.

In operation, a roll 20 of non-woven tough fiber sheet material is placed on the rolls 15 and 16 which are driven whereby the web 12 of material is released and entrained about the fixed roller 30, the dancer roller 33, the fixed roller 30′ and 30″, the tension roller 37, the support roller 14, a portion of rollers 60 and 61, and the free end is wound about the mandrel 63. While the web is wound along its path, care is taken that the material lies stretched out widthwise throughout its length. The machine is then placed in operation and perforations 46 are formed in the web 12. Once the perforations reach the mandrel 63 the start-up portion of the material is discarded and the perforated web is then wound about the mandrel 63, making sure that the material is well stretched widthwise. The machine is again placed in operation for a short period of time until the proper amount of material is wound about the mandrel. The machine is then stopped, the material removed from the mandrel, and the operation starts again.

It is within the ambit of the present invention to provide any obvious modifications of the embodiment of the perforating machine hereinabove described. For example, the rolls 30, 30' and 30'' and the dancer roll 34 can be differently arranged. This also applies to the feeder arrangement at the inlet end of the machine. Still further, the accumulator 13 at the outlet end may be made entirely different if the sheet material is to be utilized differently. However, it is noted that the accumulator herein described provides an economically desirable finished product in that the material is provided in a coreless roll. In order to achieve this, the mandrel should be of a desirable weight. It is further important to adjust the tension in the web in order to provide for the removal of the mandrel from within the rolls 64', to prevent the formation of a sloppy roll 64 and also to prevent web breakage which would result in machine stoppage.

I claim:

1. A perforating machine for making tear lines in woven or non-woevn fiber sheet material, said machine comprising feeder means for feeding a web of said sheet material, means to maintain said web stretched by applying constant tension to said web, means to stretch said web prior to perforating, perforating means having a cutting blade element supported for periodic contact with said stretched web to cut fibers in said stretch web along a line extending substantially transverse to the direction of said stretch to form a tear line while said stretch is maintained in said web, a support roll having a web engaging outer surface and maintaining said web in a stretch condition through said perforating means, means in said web engaging outer surface to permit said cutting blade element to cut stretched fibers in said stretched web to form a tear line when in contact with said web, and accumulator means to receive said web after tear lines have been made therein.

2. A perforating machine as claimed in claim 1, wherein said means in said web enaging outer surface is a longitudinal slot in said support roll.

3. A perforating machine as claimed in claim 1, wherein said cutting blade element is secured to a driven perforator roll and protrudes longitudinally from the outer surface thereof, said driven perforation roll being positioned close to said support roll whereby said cutting element will coact with said means in said web engaging outer surface to form said tear line, said support roll being a driven roll.

4. A perforating machine as claimed in claim 1, wherein said web engaging outer surface is a roughened surface to positively engage the fibers in said web.

5. A perforating machine as claimed in claim 1, wherein said cutting blade element comprises a plurality of spaced-apart substantially triangular teeth having opposed cutting edges, and a blunt area in a trough between each said tooth.

6. A perforating machine as claimed in claim 1, wherein said means to stretch said web is an idler tension roll having a web engaging outer surface, brake means is secured to said idler tension roller to slow down the rotation thereof caused by positive engagement of said web with the outer surface of said idler roll whereby said web will slow down and stretch along the longitudinal direction between said idler roll and said support roll.

7. A perforating machine as claimed in claim 1, wherein said feeder means comprises two spaced-apart substantially parallel drivable support rolls each having a web engaging outer surface, a vertical guide member adjacent the ends of said support rolls to receive and guide a support shaft extending through a core of a roll of said non-woven fiber sheet material.

8. A perforating machine as claimed in claim 1, wherein said means to maintain said web stretched comprises a plurality of stationary idler rolls spaced in parallel relationship, a dancer roll supported by said web in a loop of said web formed between two of said stationary idler rolls.

9. A perforating machine as claimed in claim 1, wherein said accumulator means comprises a pair of closely spaced parallel support rolls drivable in a common direction, a mandrel cylinder supported on and rotatable between said support rolls, said perforated web being wound about said mandrel cylinder by said support rolls.

10. A perforating machine as claimed in claim 1, wherein there is further provided one or more slitting elements for slitting said web longitudinally, and a slitter roll to guide said web against a cutting edge of said slitting element.

11. A perforating machine as claimed in claim 1, wherein said support roll constitutes said traction means.

12. A perforating machine as claimed in claim 1, wherein said cutting blade element will sever from between 50 to 98% of said stretched fibers along a line in said web to form said tear line.

13. A perforating machine as claimed in claim 12, wherein said sheet material is at least 30 inches in width.

14. A method of making perforated tear lines in a woven or non-woven fiber sheet material comprising the steps of:

i. applying longitudinal tension to a portion of a web of said material, ii. stretching said web prior to perforation, iii. supporting said stretched web on a roll having a web engaging outer surface to maintain said portion of said web in a longitudinal stretched condition in a perforating area; and iv. moving a cutting element, having a serrated cutting edge, against said stretched web in said perforating area to sever from between 50 to 98% of stretched fibers along a line extending substantially transverse to the longitudinal axis of said web.

* * * * *